United States Patent [19]

Bonvallet

[11] Patent Number: 4,724,822

[45] Date of Patent: Feb. 16, 1988

[54] VARIABLE VALVE LIFT/TIMING MECHANISM

[75] Inventor: Duane J. Bonvallet, Ann Arbor, Mich.

[73] Assignee: General Motors Corporation, Detroit, Mich.

[21] Appl. No.: 879,030

[22] Filed: Jun. 26, 1986

Related U.S. Application Data

[63] Continuation-in-part of Ser. No. 834,791, Feb. 28, 1986, Pat. No. 4,638,773.

[51] Int. Cl.[4] ..... F01L 31/14

[52] U.S. Cl. ..... 123/90.16; 123/90.27; 123/90.46; 123/90.55

[58] Field of Search ..... 123/90.15, 90.16, 90.17, 123/90.27, 90.44, 90.46, 90.55

[56] References Cited

U.S. PATENT DOCUMENTS

| | | | |
|---|---|---|---|
| 3,413,965 | 12/1968 | Gavasso | 123/90 |
| 4,438,736 | 3/1984 | Hara et al. | 123/90.16 |
| 4,484,546 | 11/1984 | Burandt | 123/90.15 |
| 4,498,432 | 2/1985 | Hara et al. | 123/90.16 |
| 4,526,142 | 7/1985 | Hara et al. | 123/90.16 |
| 4,539,951 | 9/1985 | Hara et al. | 123/90.17 |
| 4,567,861 | 2/1986 | Hara et al. | 123/90.16 |

FOREIGN PATENT DOCUMENTS 60-135610 7/1985 Japan .

*Primary Examiner*—Charles J. Myhre
*Assistant Examiner*—David A. Okonsky
*Attorney, Agent, or Firm*—Arthur N. Krein

[57] ABSTRACT

A variable valve lift and timing valve train mechanism includes a rocker arm having one end thereof operatively engaged by a valve actuator, a reaction member having one end thereof engaging an eccentric which can be rotated to change the angular position of the reaction member; a hydraulic lash adjuster including a plunger being operatively positioned in spaced apart relationship relative to the free stem end of an associate valve and substantially coaxial therewith, the plunger having an outboard pivot end projecting toward the stem of the valve, an opposite end of the rocker arm or reaction member pivotably engaging the stem of the valve while the other end pivotably engages the outboard pivot end of the plunger. The rocker arm and the reaction member intermediate their ends having opposed working surfaces one of which is flat and the other having a predetermined cam surface profile which is adapted to cooperate with the flat working surface which when engaged is operative to effect pivotal movement of one of the rocker arm or reaction member in a valve opening direction. The point of line contact between the cam surface against the flat working surface and the geometry of the cam surface cooperate to control the amount of valve lift and its timing.

4 Claims, 12 Drawing Figures

VARIABLE VALVE LIFT/TIMING MECHANISM

FIELD OF THE INVENTION

This application is a continuation-in-part of copending application Ser. No. 834,791, filed Feb. 28, 1986 and now U.S. Pat. No. 4,638,773, and assigned to the same assignee.

This invention relates to valve train mechanisms for internal combustion engines and, in particular, to a variable valve lift and variable timing valve train mechanism.

DESCRIPTION OF THE PRIOR ART

Various variable valve lift, valve train mechanisms are well known. For example, in U.S. Pat. Nos. 4,498,432 and 4,526,142 both entitled "Variable Valve Timing Arrangement for an Internal Combustion Engine or the Like", issued Feb. 12, 1985 and July 2, 1985, respectively, in the names of Seinosuke Hara, Schunichi Aoyama and Kazuyuki Miisho, there are disclosed a type of variable lift valve train mechanism in which a rocker arm is positioned so that one end thereof is adapted to be actuated either directly by a cam or by a cam actuated push rod while its other or opposite end operatively engages the free stem end of a poppet valve, such as an intake valve or exhaust valve. The upper surface of the rocker arm has a contoured portion which is adapted to abut against an upper reaction member or lever, with the contact point between the rocker arm and the lever serving as the pivot or fulcrum point of the rocker arm. The lever itself is adapted to have its angular position changed, as desired, by means of a second cam or eccentric, whereby to, in effect, vary the effective pivotable movement of the rocker arm to thereby vary both valve lift and the timing thereof. Thus in such a valve train system, valve lift is reduced by introducing lost motion between the rocker arm and the upper reaction member or lever. As such the valve train mechanism is simple and straight forward, but similar to most lost motion mechanisms, such a valve train mechanism has the disadvantage of abrupt valve lift-off and landing (seating) at reduced valve lift because a portion of the cam profile on the camshaft used for lift-off and landing of the valve is bypassed by the lost motion. This can result in excessive noise and valve train wear.

SUMMARY OF THE INVENTION

The present invention relates to an improved variable valve lift and timing valve train mechanism which, in a first embodiment, includes a rocker arm having one end thereof adapted to be operatively associated with a valve actuator, such as a cam on a rotatable camshaft or by a push rod associated with the cam, the opposite end of the rocker arm pivotably and operatively engaging the free stem end of a poppet valve; an upper reaction member having one end thereof pivotable about a center on the axis of the stem of the poppet valve when the poppet valve is in a valve closed position. The upper reaction member is normally biased toward the free stem end of the poppet valve by means of a suitable lash adjuster, and the opposite end of the upper reaction member is adapted to be engaged by a rotatable eccentric mechanism whereby valve lift and timing can be varied as desired, with the upper surface of the rocker arm intermediate its ends having a predetermined contour shaped, as desired, to produce a desired lift-off and landing motion profile of the poppet valve and which, in a second embodiment, has the rocker arm and the reaction member in reversed position, with the reaction member, in effect, operating as a second rocker arm whereby in this second embodiment the valve train mechanism includes so-called compound rocker arms.

It is therefore a primary object of this invention to provide an improved variable valve lift and timing valve train mechanism of the type having a rocker arm pivotable about a reaction member or a reaction member rocker arm wherein the control of the opening and closing of a poppet valve is, in effect, transferred from the usual cam on a camshaft to the rocker arm by providing a predetermined contour on either of the opposed working surfaces of the rocker arm or on the reaction member or reaction member rocker arm, the other surface being a flat surface.

A further object of the invention is to provide an improved variable lift and timing valve train mechanism of the type introducing lost motion between a cam actuated rocker arm and an associate reaction member or a reaction member rocker arm, wherein one of the elements has a predetermined reaction cam contour profile thereon whereby the lift-off and landing profiles of an associate poppet valve actuated thereby are unchanged by the amount of lost motion.

A further object of this invention is to provide an improved variable lift and timing valve train mechanism of the type introducing lost motion between a cam actuated rocker arm and an associated reaction member or reaction member rocker arm, wherein pivotal motion of the reaction member or reaction member rocker arm to change valve lift does not in itself cause valve lift.

For a better understanding of the invention as well as other objects and further features thereof, reference is had to the following detailed description of the invention to be read in connection with the accompanying drawings.

DESCRIPTION OF A FIRST EMBODIMENT

Figure 1:
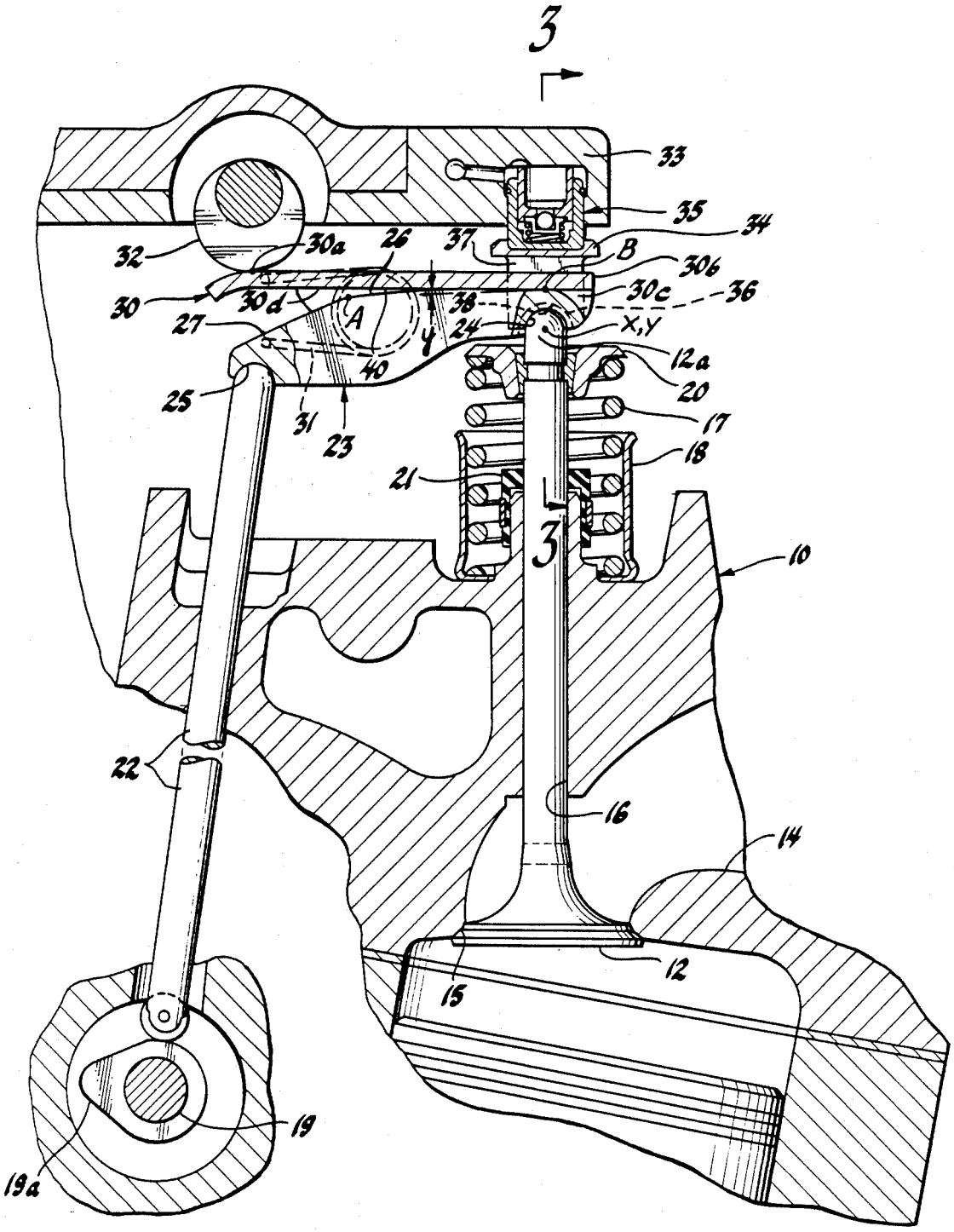
FIG. 1 is an elevational view, partially in section, of a portion of an internal combustion engine with a variable valve lift and timing valve train mechanism in accordance with the invention incorporated therein, with the poppet valve shown in a closed position and the upper reaction member of the mechanism positioned to obtain maximum valve lift.

Referring first to FIG. 1, there is shown a portion of an internal combustion engine, of the overhead valve type, having an engine body means including a cylinder head 10 in which a valve 12, in the form of a poppet valve used for either intake or exhaust, is operatively mounted to control fluid flow through a port 14 encircled by a conventional valve seat 15, with a variable lift and timing valve train mechanism, in accordance with the invention, operatively associated with the valve 12.

As conventional, the valve 12 is guided for axial reciprocation as in a valve stem guide bore 16, with the upper stem end or ball end 12*a* of the valve projecting above the cylinder head 10. In a conventional manner, the valve 12 is normally maintained in a closed position, the position shown in FIG. 1, by a valve return spring 17, with one end of the spring 17 engaging the lower washer portion of a spring damper 18 seated on the cylinder head 10 and the other end of the spring engaging a conventional spring retainer assembly 20 secured to the stem of the valve 12 in a conventional manner. A conventional valve stem seal 21 is operatively positioned so as to sealingly engage the stem of the valve 12.

In the engine construction illustrated, a push rod 22, which is reciprocably disposed in the cylinder head 10 laterally of the valve 12, has its upper semi-spherical end projecting above the cylinder head 10. As would be conventional, the lower end of the push rod 22 is operatively associated with the cam 19*a* of a camshaft 19, the enlarged profile of the cam 19*a* being illustrated in FIG. 6, in a conventional manner whereby the push rod 22 is caused to reciprocate, as determined by the profile of the cam.

Motion of the push rod 22 is imparted to the valve 12 by means of a rocker arm 23 that is adapted to engage an upper reaction member 30 that can be positioned in a manner to be described whereby it can operate as a fulcrum about which the rocker arm 23 can pivot to effect opening and closing movement of the valve 12, as desired, in a manner to be described hereinafter.

In the construction illustrated, the rocker arm 23 is provided at opposite ends thereof with semi-spherical sockets 24 and 25 to socketably receive the upper semi-spherical ball ends 12*a* of the valve 12 and the push rod 22, respectively, the rocker arm 23 thus being adapted to pivot about a pivot axis X on the reciprocating axis of the valve 12 for a purpose to be described, as determined by the preselected radius of the ball end 12*a* of the valve 12 and the complementary radius of socket 24. Thus in a given engine application, these driven and drive ends of the rocker arm, corresponding to the push rod 22 and valve 12 engaging ends, respectively, are laterally spaced apart by a distance 1, this distance 1 being referred to again hereinafter in regard to FIG. 7. In addition, in the construction shown, the upper surface of the rocker arm 23 is provided with a contoured working or cam surface 26 having a profile of generally convex configuration, as described in detail hereinafter which extends from a point B next adjacent to the socket 24 end, or right hand end with reference to FIGS. 1, 2, 4 and 5, of the rocker arm for a predetermined extent to a point A, as shown in FIG. 1, so as to merge into a downwardly extending surface 27, which, in effect, can be referred to as a non-working surface of the rocker arm as will become apparent hereinafter from an operational description of the valve train mechanism.

Referring now to the upper reaction member 30, this element is, in effect, a pivotable lever which is operatively connected to the socket 25 or driven end of the rocker arm 23 by means of a spring 31 which is operative to bias the upper reaction member 30 in an upward direction, with reference to the FIGS. 1, 2, 4 and 5, whereby one end 30*a* thereof, the left hand end with reference to these Figures, abuts against a cam or eccentric 32, as shown, which is suitably supported in an overhead support member 33 of the engine body means and which is adapted to be selectively rotated, as by a suitable drive mechanism, not shown, for a purpose to be described. In the position of the eccentric 32 shown in FIGS. 1 and 2, it has been rotated to a position whereby to effect maximum lift or opening of valve 12, whereas in the position of the eccentric 32 shown in FIGS. 4 and 5, it has been rotated to a position whereby to effect minimum lift or opening of the valve, that is, in effect, to provide for zero lift of the valve 12. Of course, angular movement of the eccentric 32 between the two positions shown, will control the angular position of the upper reaction member 30 so as to vary the lift of the valve 12, as desired, in a manner to be described.

The upper reaction member 30 is adapted, at its opposite end 30*b*, the right hand end as shown in FIGS. 1, 2, 4 and 5, to abut upward against the plunger of a suitable lash adjuster and preferably against the plunger means 34 of an otherwise conventional hydraulic lash adjuster 35 operatively positioned in a conventional manner in the overhead support member 33, at a location so as to be substantially co-axial with the reciprocating axis of the valve 12. Since the construction of such a hydraulic lash adjuster 35 is well known, it is not deemed necessary to describe such a hydraulic lash adjuster, as shown, in detail herein. However, as is well known, in a conventional hydraulic lash adjuster of the type illustrated, so-called pump up or axial extension of the plunger can be rapidly accomplished by pressurized hydraulic fluid flowing into the pressure chamber of the unit whereas axial retraction of the plunger is relatively slow because such retraction is effected as a result of the controlled leak-down of hydraulic fluid from the pressure chamber in a manner, well known in the art.

Accordingly, as a feature of the present invention, both the opposite or right hand end 30*b* of the upper reaction member 30 and the plunger means 34 of the lash adjuster are configured so that this end 30*b* of the upper reaction member 30 can pivot relative to the plunger means 34 about a pivot axis Y that is located on an extension of the reciprocating axis of the valve 12 for a purpose to be described. As shown in FIG. 1, the pivot axis X and pivot axis Y are at the same point when the valve 12 is in its closed position as shown.

Figure 2:
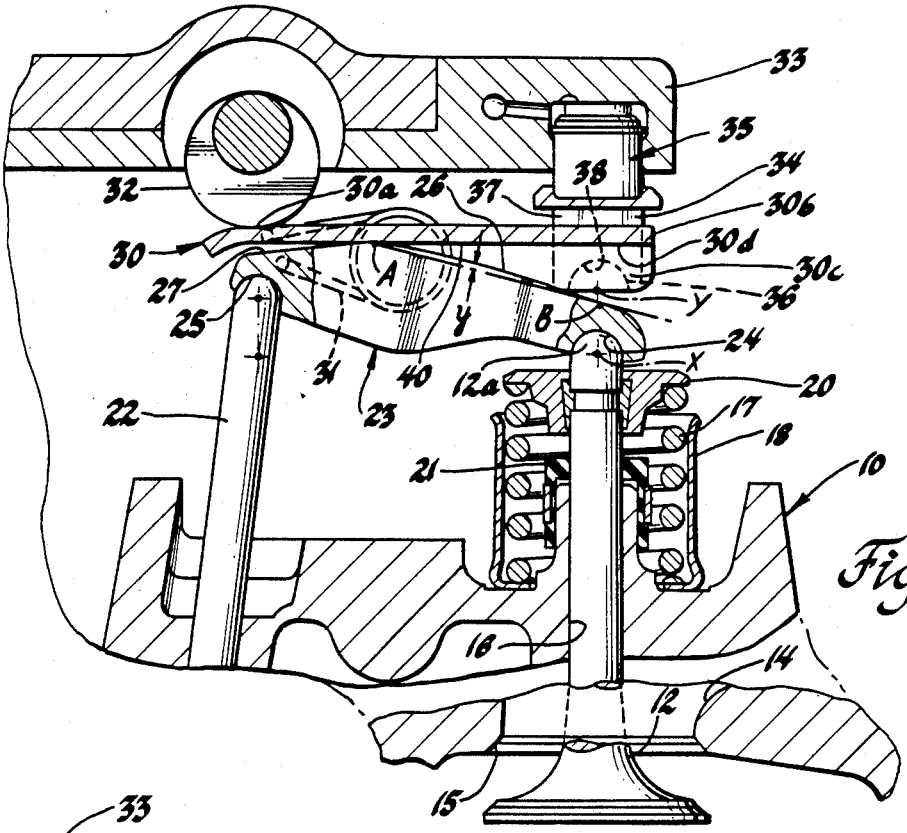
FIG. 2 is a view similar to that of FIG. 1 but with the rocker arm rotated fully in a valve opening direction.
Figure 3:
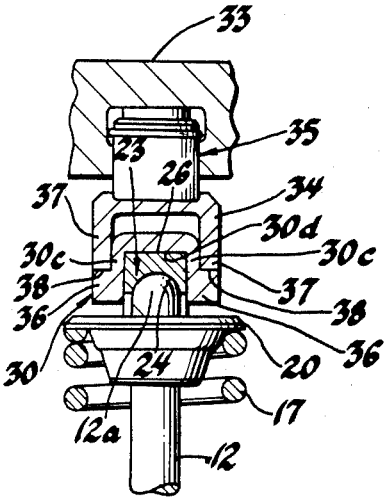
FIG. 3 is a sectional view taken along line 3—3 of FIG. 1 showing the operational relationship between the lash adjuster, upper reaction member and the end of the rocker arm engaging the free stem end of an associate poppet valve to illustrate how the upper reaction member can be pivoted about a center on the longitudinal axis of the poppet valve.

Thus, in the construction illustrated and as best seen in FIG. 3, the end 30*b* of the upper reaction member 30 on its lower side is provided with depending spaced apart side walls 30*c* defining a longitudinally extending slot 30*d* to loosely receive a portion of the socket 24 end of the rocker arm 23 and of course the valve stem end of the valve 12 that is received in the socket 24. In addition, the side walls 30*c* are each provided with an outward transverse extending, bearing arm 36, each of which is of semi-circular configuration, as best seen in FIG. 2, although also being illustrated in FIGS. 1, 4 and 5. Accordingly, the lower end of the plunger means 34 of the lash adjuster is provided with spaced apart, depending legs 37, with each of these legs being provided with a semi-spherical bearing socket 38 to pivotably receive an associate bearing arm 36.

Figure 4:
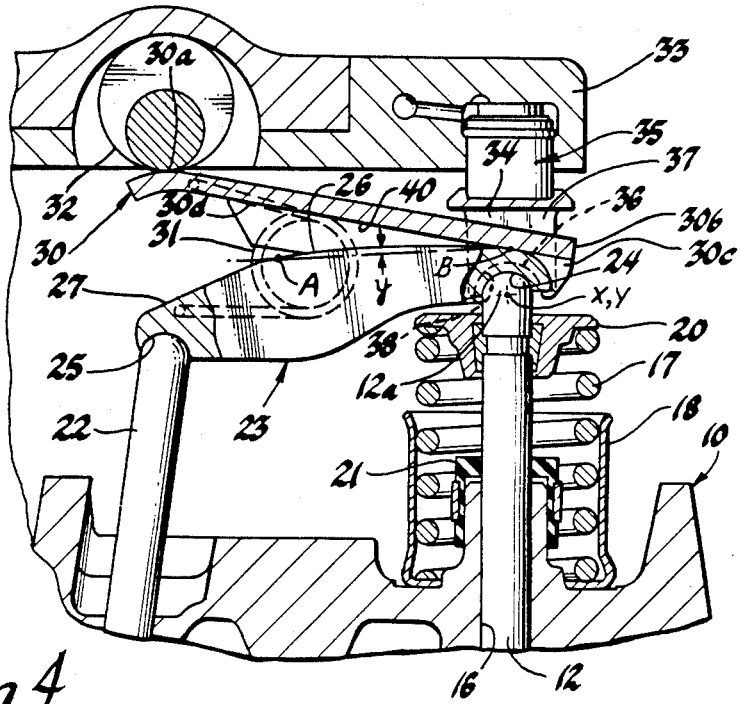
FIGS. 4 and 5 are views corresponding to those of FIGS. 1 and 2, respectively, but showing the upper reaction member pivotably moved to a position to effect zero lift of the poppet valve.

With this arrangement described above, if the upper reaction member 30 is rapidly pivoted, by way of example, as between the positions shown in FIGS. 1 and 4, its end 30*b* can freely pivot about the fulcrum point Y defined by the bearing sockets 38 and bearing arms 36 without imparting any motion to the valve 12, regardless of the axial downward extent of the plunger 34 relative to the fixed overhead support member 33.

In addition, in the construction shown, the upper reaction member 30 is provided with a lower, flat, working surface 40 which cooperates with the cam surface 26 of the rocker arm 23 to operate as a fulcrum for the rocker arm whereby the latter can be, in effect, operatively fixed for pivotable movement relative to the upper reaction member so as to control the opening and closing movement of the valve 12.

Operation of the Valve Train

Figure 6:
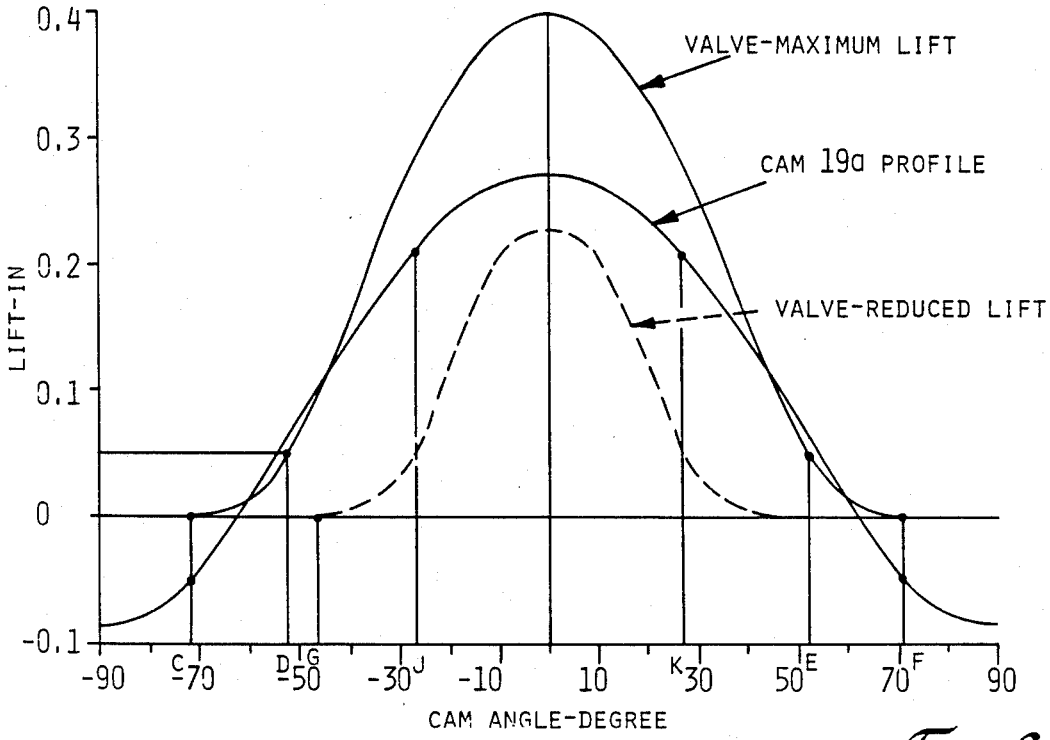
FIG. 6 is a graph showing an enlarged view of a cam profile and the valve lift motion during the various degrees of cam angle rotation.

Reference is now made to FIGS. 1 and 2 and to FIG. 6 which graphs the motion of the rocker arm as controlled by the cam ramp of the cam 19*a* and the valve 12. As best seen in FIG. 6, during rotation of the cam 19*a*, the rocker arm 23 is launched on a pivotable cycle prior to valve 12 actuation, from the position shown in FIG. 1, to acquire the desired necessary velocity, which is then nominally held constant during rotation of the cam 19*a* in degrees of rotation from C to J and K to F with reference to FIG. 6. During this initial pivoting movement of the rocker arm 23, it is free to pivot about the pivot axis X and, thus does not effect any axial movement of the valve 12.

For maximum valve 12 lift, the eccentric 32 is positioned as shown in FIGS. 1 and 2, with the upper reaction member 30 thus moved to its most counterclockwise position about pivot axis Y, so that valve 12 motion begins at C, with reference to FIG. 6, and the valve 12 lift profile from C to D is determined by the cam surface 26 contour between points AB, which can be contoured in a manner to be described in detail hereinafter. As lift continues, the rocker arm 23 essentially pivots about point A, as seen in FIG. 2, and the valve 12 lift profile from D to E is determined by the high lift portion of the lobe of cam 19*a*, graphically illustrated in FIG. 6. The landing or valve 12 seating profile from E to F, with reference to FIG. 6, is the reverse of the opening profile and is determined by the cam surface 26 contour between AB.

Valve 12 lift can be reduced by angular movement of the eccentric 32 so that the upper reaction member 30 will pivot about pivot axis Y in a clockwise direction with reference to FIGS. 1 and 2. Thus if the upper reaction member 30 is pivoted in a clockwise direction to a position intermediate from that which is shown in FIGS. 1 and 2 and the position shown in FIGS. 4 and 5, additional lost motion is introduced so as to delay the point at which valve 12 motion begins, for example, to point G in FIG. 6. Up to point G, in this example, rocker arm 23 essentially pivots between the flat working surface 40 of the upper reaction member 30 and the semi-spherical end of valve 12. When valve 12 lift begins, the lift off profile is the same as with maximum lift because this profile is still determined by the cam surface 26 contour between AB and the high lift portion of the lobe of cam 19*a*. Thus unlike most lost motion mechanisms, with the subject valve train mechanism the lift-off and landing profiles of the valve 12 are unchanged by the amount of lost motion as seen by the valve lift graphs in FIG. 6.

Figure 5:
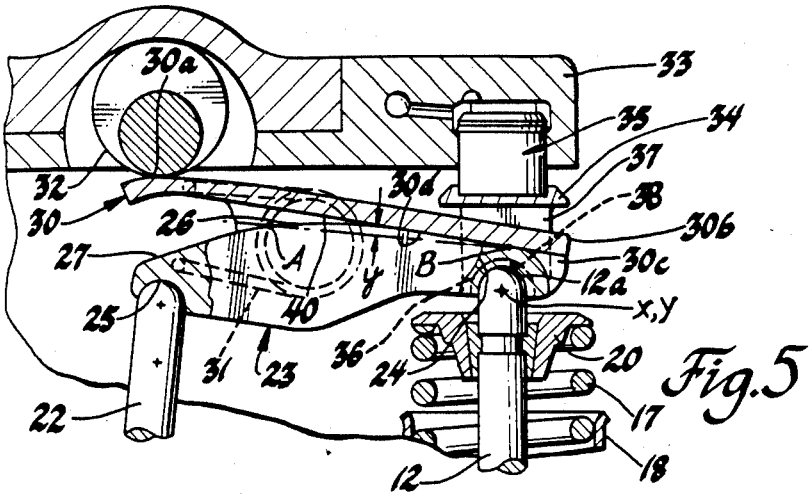

Referring now to FIGS. 4 and 5, it will be seen that if the eccentric 32 is rotated to the position shown, the upper reaction member 30 will pivot about pivot axis Y in a clockwise direction to its maximum clockwise extent, the position illustrated in these Figures. In this position of the upper reaction member 30, during rotation of the operating cam 19*a* to effect upward movement to the push rod 22 position shown in FIG. 5, it will merely cause the rocker arm 23 to pivot about the pivot axis X and, in effect, also about pivot axis Y, resulting in zero lift of the valve 12, with the cam surface 26 between AB never coming into direct working engagement with the lower flat working surface 40 of the upper reaction member 30. Stated in a somewhat different manner, in this angular position of the upper reaction member 30, point B on the cam surface 26 profile is located, with reference to FIGS. 1, 2, 4 and 5, at a position slightly to the left of the reciprocating axis of the valve 12 and, thus, in effect, the upper reaction member 30 is angularly positioned so that it cannot serve as a fixed fulcrum for the cam surface 26 contour on the rocker arm 23. Accordingly, it will now be apparent that the subject valve train mechanism can also be used to deactivate a valve.

By locating point B of the cam surface 26 contour on the rocker arm 23 slightly to the left of the axis of the valve 12, with reference to FIGS. 1, 2, 4 and 5, the rocker arm 23 during initial pivotal movement is thus free to pivot about axis point X to obtain a desired velocity before the cam surface 26 contour can possibly engage the opposed working surface of the upper reaction member 30. In a particular application, this offset of point B from the reciprocating axis of the valve 12 was equal to about 7/10 degrees of cam 19*a* rotation.

Figure 7:
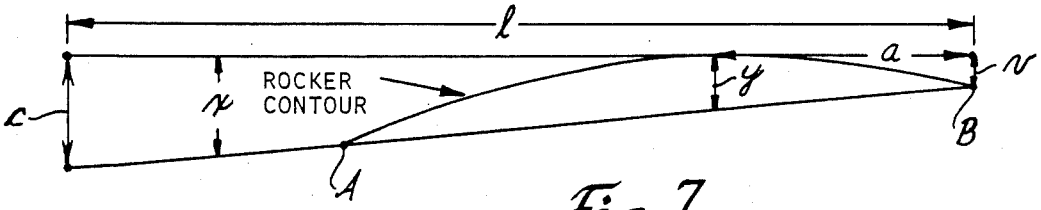
FIG. 7 is a graphic illustration of how the rocker arm reaction cam contour profile is developed based on a preselected cam lift and desired maximum valve lift.

Referring now to FIG. 7, the cam surface 26 contour or profile can be calculated, that is plotted, for each degree of rotation of the lobe of cam 19*a* on the cam of the camshaft, knowing the desired maximum valve 12 lift off and the cam lift data for a particular engine application by the use of the following equation:

$$y = a\frac{c - v}{l} + v$$

wherein:

v = valve lift c = cam lift a = position of cam surface 26 contact with the working surface 40 of the upper reaction member 30 l = distance between the pivot axis of the push rod 22 and valve 12 relative to rocker arm 23 and thus is a straight line connecting the upper ends of the vertical lines representing c and v y = height above a straight line extending between the lower ends of the lines representing c and v, as shown in FIGS. 2 and 7.

The above equation, with reference to FIG. 7 is derived as follows:

$$\text{tangent} = \frac{c - v}{l}$$

$$= \text{arctangent } \frac{c - v}{l}$$

$$\text{tangent} = \frac{y - v}{a}$$

$$y = a \text{ tangent} + v$$

therefore $$y = a\frac{c - v}{l} + v$$

It will be apparent to those skilled in the art that there may be other ways by which the cam surface 26 profile may be obtained so as to provide for a desired lift-off and landing profile for the valve 12 in a particular engine application. However, it should also now be apparent that the lift-off and landing of the valve 12 should preferably occur during the nearly constant velocity portion of the preselected cam 19*a* profile, so that the lift-off and landing profiles for the valve 12 will be substantially the same. It will also be apparent that as the valve 12 approaches maximum lift, for a particular angular position of the upper reaction member 30, the cam 19*a* lift velocity is slowing to zero and, of course, with the arrangement as shown in FIG. 6, the lift-off and landing profiles will be relatively gradual. The result is a smooth opening of the valve 12 and substantially no impact at closing of the valve 12 for all lifts at all engines speeds.

An alternate or second embodiment of a variable valve lift/timing mechanism in accordance with the invention is shown in FIGS. 8–12, wherein similar parts are designated by similar numerals but with the addition of a prime (′) where appropriate.

Referring now to FIGS. 8, 9, 11 and 12, there is shown a portion of an internal combustion engine, of the overhead cam type, having an engine body means including a cylinder head 10′ in which a poppet valve 12, either intake or exhaust, is operatively mounted to control fluid flow through a port 14 encircled by a valve seat, with a variable lift and timing valve train mechanism, in accordance with the alternate or second embodiment of the subject invention operatively associated with the poppet valve 12.

In this alternate or second embodiment, the valve mechanism includes a compound rocker arm arrangement which includes a first rocker arm 23′ and a second rocker arm or reaction member 30′, the first rocker arm 23′ being adapted to engage the second rocker arm or reaction member 30′ whereby the latter is used to effect opening and closing movement of the poppet valve 12, as desired, in a manner to be described in detail hereinafter.

In the construction illustrated, the rocker arm 23′ is provided at one or bifurcated end thereof with a fixed roller shaft 50 that rotatably supports a cam follower roller 51 in operative association with the cam 19*a* of a camshaft 19, the enlarged profile of the cam 19*a* being similar to that illustrated in FIG. 6. The rocker arm 23′ at its opposite or right hand end, with reference to FIGS. 8, 9, 11 and 12, is adapted to abut upward against the plunger of a suitable lash adjuster and preferably against the plunger means 34 of an otherwise conventional hydraulic lash adjuster 35 operatively positioned in a conventional manner in the overhead support member 33, at a location so as to be substantially co-axial with the reciprocating axis of the poppet valve 12. As is well known and as previously described, in a conventional hydraulic lash adjuster of the type illustrated, so-called pump up or axial extension of the plunger can be rapidly accomplished by pressurized hydraulic fluid flowing into the pressure chamber of the unit whereas axial retraction of the plunger is relatively slow because such retraction is effected as a result of the controlled leak-down of hydraulic fluid from the pressure chamber in a manner, well known in the art.

Figure 8:
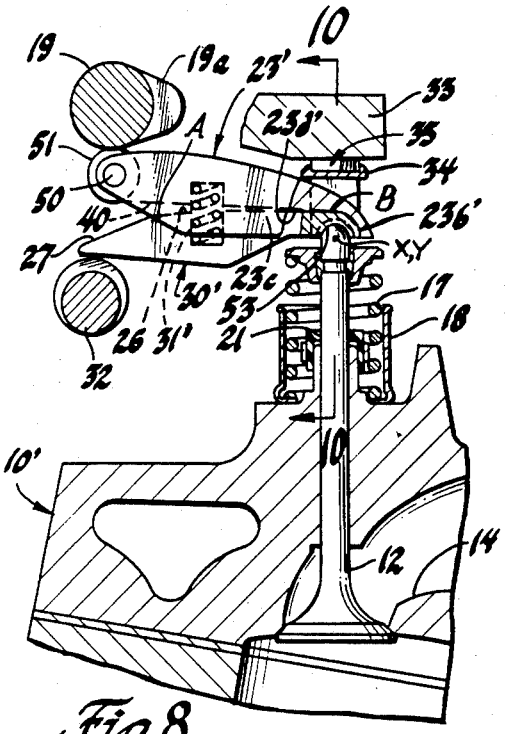
FIG. 8 is an elevational view, partially in section, of a portion of an enternal combustion engine with a variable valve lift and timing valve train mechanism in accordance with an alternate second embodiment of the invention incorporated therein, with the poppet valve shown in a closed position and a lower reaction member in the form of a second rocker arm of the mechanism positioned so as to obtain maximum valve lift.
Figure 11:
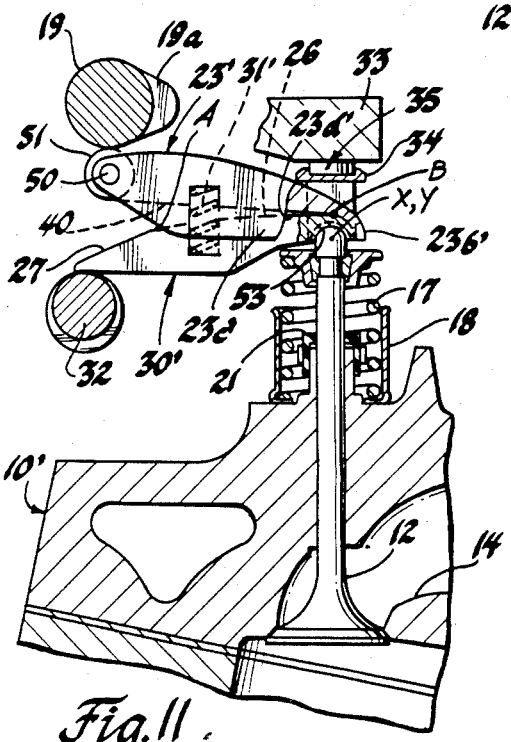
Figure 12:
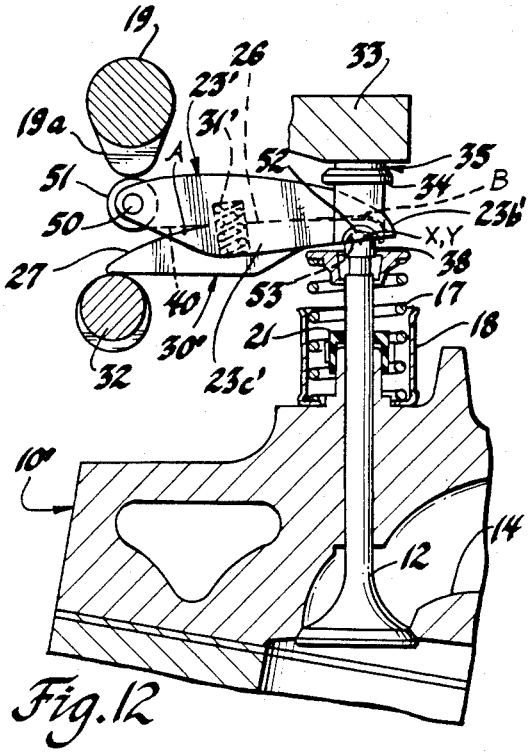

Accordingly, as a feature of the present invention, both the opposite or right hand end 23*b′* of the rocker arm 23′ and the plunger means 34 of the lash adjuster are configured so that this end 23*b′* of the rocker arm 23′ can pivot relative to the plunger means 34 about a pivot axis Y that is located on an extension of the reciprocating axis of the poppet valve 12 for a purpose to be described. As shown in FIGS. 8, 11 and 12, a pivot axis X to be described and pivot axis Y are located at the same point when the poppet valve 12 is in its closed position as shown in these Figures.

Figure 9:
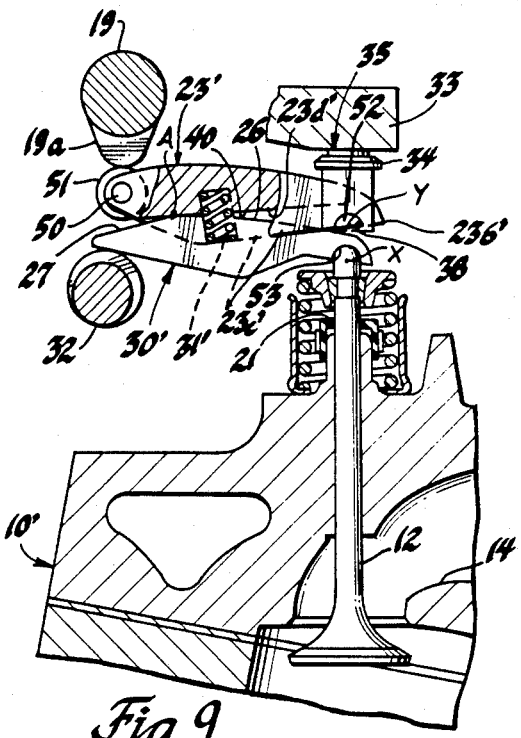
FIG. 9 is a view similar to that of FIG. 8 but with the compound rocker arms of the mechanism rotated fully in a valve opening direction.
Figure 10:
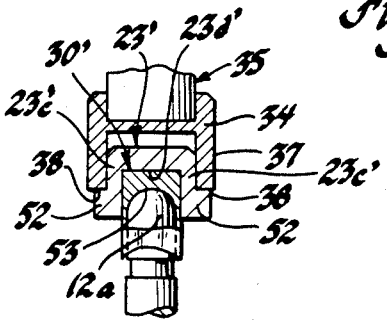
FIG. 10 is a sectional view taken along line 10—10 of FIG. 8, but with the spring retainer assembly removed; and, FIGS. 11 and 12 are views corresponding to those of FIGS. 8 and 9, respectively, but showing the lower reaction member or second rocker arm pivotably moved to a position to effect zero lift of the poppet valve.

Thus, in the construction illustrated and as best seen in FIG. 10, the end 23*b′* of the rocker arm 23′ on its lower side is provided with depending spaced apart side walls 23*c′* defining a longitudinally extending slot 23*d′* to loosely receive a portion of the socket end of the second rocker arm or reaction member 30′ to be described. In addition, the side walls 23*c′* are each provided with an outward transverse extending, bearing arm 52, each of which is of semi-circular configuration, as best seen in FIG. 10, although also being illustrated in FIGS. 8, 9, 11 and 12. Accordingly, the lower end of the plunger means 34 of the lash adjuster is provided with spaced apart, depending legs 37, with each of these legs being provided with a semi-spherical bearing socket 38 to pivotably receive an associate bearing arm 52.

With this arrangement described above, if the rocker arm 23′ is rapidly pivoted, by way of example, as between the positions shown in FIGS. 8 and 9, its end 23*b′* can freely pivot about the fulcrum point Y defined by the bearing sockets 38 and bearing arms 52 without imparting any direct motion to the poppet valve 12, regardless of the axial downward extent of the plunger means 34 relative to the fixed overhead support member 33.

In addition, in the construction shown, the rocker arm 23′ is provided with a lower, flat, working surface 40 which cooperates with the cam surface 26 of the second rocker arm or reaction member 30′ to be described so as to operate as a fulcrum for the second rocker arm or reaction member 30′ whereby the latter can be, in effect, operatively fixed for pivotable movement relative to the upper rocker arm 23′ so as to control the opening and closing movement of the valve 12.

Referring now to the second rocker arm or reaction member 30' this element is, in effect, a pivotable rocker arm, which at one end, the right hand end with reference to FIGS. 8, 9, 11 and 12, is provided with a socket 53 to socketably receive the upper semi-spherical ball end 12*a* of the stem of the poppet valve 12. This second rocker arm or reaction member 30' is normally biased by means of a spring 31', received in suitable sockets provided for this purpose in the rocker arm 23' and reaction member 30' so as to bias the reaction member in a downward or counterclockwise direction so that its opposite or left hand end will abut against a cam or eccentric 32, as shown, which is suitably pivotably supported in the overhead support member 33 of the engine body means and which is adapted to be selectively rotated, as by a suitable drive mechanism, not shown, for a purpose to be described. This spring 31' also biases the rocker arm 23' in a direction so that its cam follower roller 51 operatively engages the cam 19*a*.

The reaction member 30' is thus adapted to pivot about its fixed contact point on the eccentric 32 at one end thereof and at its opposite end about a pivot axis X on the reciprocating axis of the poppet valve 12 for a purpose to be described, as determined by the preselected radius of the ball end 12*a* of the valve 12 and the complementary radius of socket 53. Thus in a given engine application, these fixed and driven ends of the reaction member 30', corresponding to the eccentric 32 and valve 12 engaging ends, respectively, are laterally spaced apart by a distance 1, this distance 1 being referred to in regard to FIG. 7 as previously described. In addition, in the construction shown, the upper surface of the reaction member 30' is provided with a contoured working or cam surface 26 having a profile of generally convex configuration, as previously described in detail hereinbefore, with reference to FIG. 7, which extends from a point B next adjacent to the socket 38 end, or right hand end with reference to FIGS. 8, 9, 11 and 12, of the reaction member 30' for a predetermined extent L to a point A, as shown in these Figures, so as to merge into a downwardly extending surface 27, which, in effect, can be referred to as a non-working surface of this secondary rocker arm or reaction member 30'.

In the position of the eccentric 32 shown in FIGS. 8 and 9, it has been rotated to a position whereby to effect maximum lift or opening of valve 12, whereas in the position of the eccentric 32 shown in FIGS. 11 and 12, it has been rotated to a position whereby to effect minimum lift or opening of the valve 12, that is, in effect, to provide for zero lift of this valve 12. Of course, angular movement of the eccentric 32 between the two positions shown, will control the angular position of the reaction member 30' so as to vary the lift and timing of the valve 12, as desired, in a manner to be described.

Operation of the Alternate or Second Embodiment Valve Train

Reference is now made to FIGS. 8 and 9 which illustrate the eccentric 32 rotated to a position to obtain maximum lift of the poppet valve 12. During rotation of the cam 19*a*, the rocker arm 23' is launched on a pivotable cycle prior to valve 12 actuation, from the position shown in FIG. 8, to acquire the desired necessary velocity, which is then nominally held constant during rotation of the cam 19*a* in degrees of rotation from C to J and K to F with reference to FIG. 6. During this initial pivoting movement of the rocker arm 23', it is free to pivot about the pivot axis Y and, thus does not effect any axial movement of the valve 12.

For maximum valve 12 lift, the eccentric 32 is positioned as shown in FIGS. 8 and 9, with the reaction member 30' thus moved to its most clockwise position about pivot axis X, so that valve 12 motion begins at C, with reference to FIG. 6, and the valve 12 lift profile from C to D is determined by the cam surface 26 contour between points AB, which can be contoured in a manner previously described in detail hereinabove. As lift continues, the rocker arm 23' essentially then abuts against point A on the reaction member 30' as seen in FIG. 9, thus causing this reaction member 30' to pivot about its fulcrum contact point on the eccentric 32 to effect the opening movement of the valve 12 to the position shown in FIG. 9. The actual valve 12 lift profile from D to E is determined by the high lift portion of the lobe of cam 19*a*, graphically illustrated in FIG. 6. The landing or valve 12 seating profile from E to F, with reference to FIG. 6, is the reverse of the opening profile and is determined by the cam surface 26 contour between AB.

Valve 12 lift can be reduced by angular movement of the eccentric 32 so that the rocker arm 23' will pivot about pivot axis Y in a counterclockwise direction from the position shown in FIGS. 8 and 9. Thus if the reaction member 30' is pivoted in a counterclockwise direction to a position intermediate from that which is shown in FIGS. 8 and 9 and the position shown in FIGS. 11 and 12, additional lost motion is introduced so as to delay the point at which valve 12 motion begins, for example, to point G in FIG. 6. Up to point G, in this example, rocker arm 23' essentially pivots between its flat working surface 40 and the contoured surface 26 on the reaction member 30' and the semi-spherical bearing socket 38 about the axis Y. When valve 12 lift begins, the lift off profile is the same as with maximum lift because this profile is still determined by the cam surface 26 contour between AB and the high lift portion of the lobe of cam 19*a*. Thus unlike most lost motion mechanisms, with this valve train mechanism the lift-off and landing profiles of the valve 12 are unchanged by the amount of lost motion as seen by the valve lift graphs in FIG. 6.

Referring now to FIGS. 11 and 12, it will be seen that if the eccentric 32 is rotated to the position shown, the reaction member 30' will pivot about pivot axis X in a counterclockwise direction to its maximum counterclockwise extent, the position illustrated in these Figures. In this position of the reaction member 30', during rotation of the operating cam 19*a* to effect pivotal movement of the rocker arm 23', it will merely cause the rocker arm 23' to pivot about the pivot axis Y and, in effect, also about pivot axis X, resulting in zero lift of the valve 12, with the cam surface 26 on the reaction member 30', between AB, never coming into direct working engagement with the lower flat working surface 40 of the rocker arm 23'. Stated in a somewhat different manner, in this angular position of the reaction member 30', point B on the cam surface 26 profile is located, with reference to FIGS. 8, 9, 11 and 12, at a position slightly to the left of the reciprocating axis of the valve 12 and, thus, in effect, the reaction member 30' is angularly positioned so that it cannot serve as a fixed contact point for the rocker arm 23' in order to effect pivotable movement of the reaction member 30'. Accordingly, it will now be apparent that this valve train mechanism can also be used to deactivate a valve.

By locating point B of the cam surface 26 contour on the reaction member 30' slightly to the left of the axis of the valve 12, with reference to FIGS. 8, 9, 11 and 12, the rocker arm 23' during initial pivotal movement is thus free to pivot about axis point Y to obtain a desired velocity before the cam surface 26 contour on the reaction member 30' can possibly be engaged by the opposed working surface 40 of the rocker arm 23'. In a particular application, this offset of point B from the reciprocating axis of the valve 12 was equal to about 7/10 degrees of cam 19*a* rotation.

As previously described, it will be apparent to those skilled in the art that there may be other ways by which the cam surface 26 profile may be obtained, other than as previously described herein, so as to provide for a desired lift-off and landing profile for the valve 12 in a particular engine application. However, it should also now be apparent that the lift-off and landing of the valve 12 should preferably occur during the nearly constant velocity portion of the preselected cam 19*a* profile, so that the lift-off and landing profiles for the valve 12 will be substantially the same. It will also be apparent that as the valve 12 approaches maximum lift, for a particular angular position of the reaction member 30', the cam 19*a* lift velocity is slowing to zero and, of course, with the arrangement as shown in FIG. 6, the lift-off and landing profiles will be relatively gradual. The result is a smooth opening of the valve 12 and substantially no impact at closing of the valve 12 for all lifts at all engines speeds.

While the invention has been described with reference to the structures disclosed herein, it is not intended to be confined to the specific details set forth, since it is apparent that many modifications and changes can be made by those skilled in the art. For example, in both embodiments disclosed the same function can be achieved by forming the cam surface contour on either the reaction member or on the rocker arm and using an opposed flat working surface on the rocker arm or reaction member. This application is therefore intended to cover such modifications or changes as may come within the purposes of the improvements or the scope of the following claims.

The embodiments of the invention in which an exclusive property or privilege is claimed are defined as follows:

1. A valve train for an internal combustion engine of the type having a body means defining a cylinder with a port, said valve train including a valve with an axial extending valve stem located for axial movement in said port and normally biased to a predetermined position; a valve actuator spaced from said valve and operable to effecting reciprocation of said valve; a rocker arm having a first end and an opposite second end, with said first end thereof engaging said valve actuator; said body means including a fixed overhead support means extending over said rocker arm and spaced therefrom a predetermined distance; a lash adjuster including a plunger means operatively positioned in said overhead support means with said plunger means having an outboard end projecting toward said valve stem in substantial coaxial spaced apart alignment therewith, a pivotable eccentric means operatively positioned in spaced apart relationship to said valve actuator, a reaction member having a first end and an opposite second end, said first end of said reaction member being pivotably supported at one end by said eccentric means; and a spring means operatively associated with said rocker arm and with said reaction member to bias said first end of said reaction member into engagement with said eccentric and to bias said first end of said rocker arm into engagement with said valve actuator; said second end of said reaction member pivotally engaging said valve stem and the second end of said rocker arm abutting against said outboard end of said plunger means so as to be pivotably supported by said outboard end of said plunger means; said reaction member and said rocker arm having opposed working surfaces one of which is flat and the other of which has a cam surface contour terminating at spaced apart points, said cam surface contour being in accordance with the following equation $$y = a\frac{c - v}{l} + v$$

wherein:

v=maximum valve lift c=cam lift a=position of cam surface contact with the working surface of the upper reaction member 1=distance between the pivot axis of the valve actuator and said valve stem relative to the rocker arm connecting one end of the vertical lines representing c and v y=height above a straight line extending between the opposite end of the lines representing c and v.

2. A valve train for an internal combustion engine of the type having a body means defining a cylinder with a port, said valve train including a valve with an axial extending valve stem located for axial movement in said port and normally biased to a predetermined position; a valve actuator spaced from said valve and operable to effect reciprocation of said valve; a rocker arm having a first end and an opposite second end, said first end thereof engaging said valve actuator; said body means including a fixed overhead support means extending over said rocker arm and spaced therefrom a predetermined distance; a lash adjuster including a plunger means operatively positioned in said overhead support means with said plunger means having an outboard pivot end means projecting toward said valve stem in substantial coaxial alignment therewith, a pivotable eccentric means operatively located in spaced apart relationship to said valve actuator, a reaction member having a first end and an opposite second end, said first end of said reaction member being pivotably supported at one end by said eccentric means, the said opposite second end of said reaction member pivotably engaging said valve stem and said opposite second end of said rocker arm pivotably engaging said outboard pivot end means of said plunger means; and a spring means operatively associated with said rocker arm and with said reaction member to bias said one end of said reaction member into engagement with said eccentric and said one of said rocker arm into engagement with said valve actuator; said reaction member and said rocker arm having opposed working surfaces one of which is flat and the other of which has a cam surface contour terminating at spaced apart points, said cam surface contour being in accordance with the following equation $$y = a\frac{c - v}{l} + v$$

wherein:

v=maximum valve lift
c=cam lift
a=position of cam surface contact with the working surface of the upper reaction member
1=distance between the pivot axis of the valve actuator and said valve stem ralative to the rocker arm connecting one end of the vertical lines representing c and v
y=height above a straight line extending between the opposite end of the lines representing c and v.

3. A valve train for an internal combustion engine of the type having a body means defining a cylinder with a port, said valve train including a valve with an axial extending stem located for axial movement in said port and normally biased to a port closed position, a valve actuator spaced from said valve and operable of effect reciprocation of said valve, a rocker arm having a first end and an opposite second end, said first end of said rocker arm engaging said valve actuator, said body means including a fixed overhead support means extending over said rocker arm and spaced thereform a predetermined distance, a lash adjuster oparatively positioned in said overhead support means, said lash adjuster including an axial movable plunger having an outboard end projecting from said overhead support means toward said stem in substantial coaxial alignment with the axis of movement of said valve, a pivotable eccentric means operatively positioned in spaced apart relationship to said valve actuator; a reaction member having a first end and a second end with said second end being pivotably supported on said stem with said first end engaging said eccentric means; the said opposite end of said rocker arm being pivotably supported by said outboard end of said plunger; and a spring means operatively associated with said rocker arm and with said reaction member to bias said opposite end of said reaction member into engegement with said eccentric and to bias said second end of said rocker arm into engagement with said valve actuator; said reaction member and said rocker arm having opposed working surfaces one of which is flat and the other of which has a cam surface contour whereby after a predetermined pivotable movement of said rocker arm said opposed working surfaces are in operational contact with each other whereby said working surface of said reaction member can be engaged by said rocker arm whereby to effect pivotable movement of said reaction member to effect opening movement of said valve, the amount of lift and timing thereof of said valve being controlled by the angular position of said eccentric.

4. A valve train for an internal combustion engine of the type having a body means defining a cylinder with a port, said valve train including a valve with an axial extending valve stem located for axial movement relative to said port and normally biased to a port closed position, a valve actuator spaced from said valve and operable to effect reciprocation of said valve; a pivotable eccentric means operatively positioned in spaced apart relationship to said valve actuator; said body means including a fixed overhead support means extending over said rocker arm and spaced therefrom a predetermined distance; a hydraulic lash adjuster having a plunger means operatively positioned by said overhead support means with said plunger means having an outboard pivot end projecting toward said valve stem in substantial coaxial alignment therewith; a rocker arm having one end and an opposite end pivotably supported at said one end by said outboard pivot end of said plunger means and at said opposite end engaging said valve actuator; a reaction member pivotably supported at one end on said valve stem with an opposite end thereof being adapted to be engaged by said eccentric means; and, a spring means operatively associated with said rocker arm and with said reaction member to bias said opposite end of said reaction member into engagement with said eccentric means and bias said rocker arm into engagement with said valve actuator; said rocker arm having a flat working surface and said reaction member having an opposed cam surface contour thereon whereby after a predetermined pivotable movement of said rocker arm said opposed working surfaces are in operational contact with each other whereby said working surface of said reaction member will be engaged by said rocker arm whereby to effect pivotable movement of said reaction member to effect opening movement of said valve, the amount of lift and timing thereof of said valve being controlled by the angular position of said eccentric and thus of said reaction member.

* * * * *